US008695795B1

(12) United States Patent
Huber

(10) Patent No.: US 8,695,795 B1
(45) Date of Patent: Apr. 15, 2014

(54) INTERCONNECTABLE PORTABLE CONTAINER SYSTEMS

(76) Inventor: Jason W. Huber, Mormon Lake, AZ (US)

( * ) Notice: Subject to any disclaimer, the term of this patent is extended or adjusted under 35 U.S.C. 154(b) by 155 days.

(21) Appl. No.: 12/500,539

(22) Filed: Jul. 9, 2009

Related U.S. Application Data

(60) Provisional application No. 61/079,796, filed on Jul. 10, 2008.

(51) Int. Cl.
*G11B 33/02* (2006.01)

(52) U.S. Cl.
USPC ..... 206/308.1; 206/503; 206/501; 312/107

(58) Field of Classification Search
USPC ..... 206/308.1, 387.1, 511, 509, 501, 206/503–504; 312/111, 107, 108, 348.3; 220/23.6
See application file for complete search history.

(56) References Cited

U.S. PATENT DOCUMENTS

| | | | | |
|---|---|---|---|---|
| 3,514,170 | A * | 5/1970 | Shewchuk | 312/107 |
| 3,563,624 | A | 2/1971 | Stice | |
| 3,710,900 | A | 1/1973 | Fink | |
| 3,822,924 | A * | 7/1974 | Lust | 312/111 |
| 3,974,898 | A | 8/1976 | Tullis et al. | |
| 4,202,586 | A | 5/1980 | Oplinger | |
| 4,262,605 | A | 4/1981 | Sokol | |
| 4,595,246 | A * | 6/1986 | Bross | 312/348.3 |
| 5,281,020 | A * | 1/1994 | Romick | 312/308 |
| 5,407,074 | A | 4/1995 | Brightbill et al. | |
| 5,466,058 | A * | 11/1995 | Chan | 312/111 |
| 5,667,287 | A | 9/1997 | Gunning et al. | |
| 5,848,709 | A | 12/1998 | Gelphman et al. | |
| 6,149,019 | A | 11/2000 | Newman | |
| 6,193,340 | B1 * | 2/2001 | Schenker et al. | 312/265.5 |
| 6,557,955 | B2 * | 5/2003 | Saravis | 312/111 |
| 6,991,115 | B2 * | 1/2006 | Chow et al. | 211/40 |
| 7,100,999 | B2 | 9/2006 | Stravitz | |
| 2002/0070641 | A1 | 6/2002 | Ragan et al. | |
| 2006/0049725 | A1 | 3/2006 | Simon | |
| 2006/0076261 | A1 * | 4/2006 | Kurtenbach | 206/511 |
| 2006/0152114 | A1 * | 7/2006 | Yamada | 312/107 |
| 2007/0051721 | A1 * | 3/2007 | Wu | 220/23.6 |

* cited by examiner

*Primary Examiner* — J. Gregory Pickett
*Assistant Examiner* — Robert Poon
(74) *Attorney, Agent, or Firm* — Cahill Glazer PLC

(57) ABSTRACT

A system used for organizing, storing, and transporting multimedia and related paperwork for use by, for example, a disc jockey. The interconnectable, portable container-system includes a box, with a top, bottom, back and two sides. It further includes accessories such as a large divider, and drawers and may be further divided by a small divider and mini dividers according to user's intended application of use. Boxes can be inter-connected for efficient storage and portability using the system described.

4 Claims, 5 Drawing Sheets

INTERCONNECTABLE PORTABLE CONTAINER SYSTEMS

CROSS-REFERENCE TO RELATED APPLICATION

The present application is related to and claims priority from prior provisional application Ser. No. 61/079,796, filed Jul. 10, 2008, entitled "INTERCONNECTABLE PORTABLE CONTAINER SYSTEMS", the content of which is incorporated herein by this reference and is not admitted to be prior art with respect to the present invention by the mention in this cross-reference section.

BACKGROUND

This invention relates to providing a system for improved interconnectable, portable containment. More particularly, this invention relates to providing a system for stackable containers for storage of multimedia.

Problems exist when persons attempt to organize, store, and transport multimedia. Multimedia comes in various sizes and odd shapes thereby creating a difficulty as to what size and shape would best serve the purpose for organizing, storing, and transporting such multimedia. Multimedia can take the form of compact discs "CD"s, vinyl records, cassette tapes, digital video disks "DVD"s, and other.

Disc jockeys ("DJ"s) and entertainers require a portable, durable, efficient means for organizing, storing and transporting the multimedia at and between shows. DJs also require a means to keep files, lyrics, and song lists for business and entertainment purposes. Collectors of vintage vinyl records face similar problems, frequently related to the storage of their album collections.

Thus, a need exists for a handy, portable, durable system to house various dimensioned multimedia and any related paperwork and to avoid the above-mentioned problems.

OBJECTS AND FEATURES OF THE INVENTION

A primary object and feature of the present invention is to provide a system overcoming the above-mentioned problem.

It is a further object and feature of the present invention to provide such a system that permits storage, portability, and display of multimedia of various sizes and shapes.

It is a further object and feature of the present invention to provide such a system that permits storage of vinyl albums, compact disks, digital video disks, and cassette tapes.

It is a further object and feature of the present invention to provide such a system that permits portability of such multimedia items.

It is another object and feature of the present invention to provide such a system that has rigidity and stacking strength to store and transport such multimedia.

It is another object and feature of the present invention to provide such a system that allows physical storing boxes to be interconnected using mating projecting and recessed surfaces.

It is a further object and feature of the present invention to provide such a system that permits storage and transport of paperwork, namely business files, song lists, and lyrics related to a DJ business.

It is a further object and feature of the present invention to provide such a system that permits organization for a variety of items that a DJ may need to operate his business.

It is another object and feature of the present invention to provide such a system that has accessories that can be configured and reconfigured according to user-preference or specific application.

It is another object and feature of the present invention to provide such a system that provides a functional display.

It is a further object and feature of the present invention to provide such a system that can be used as a shipping container.

It is another object and feature of the present invention to provide such a system that can be utilized as items of furniture.

A further primary object and feature of the present invention is to provide such a system that is efficient, inexpensive, and handy. Other objects and features of this invention will become apparent with reference to the following descriptions.

SUMMARY OF THE INVENTION

In accordance with a preferred embodiment hereof, this invention provides a portable container system, relating to the storage and transport of at least one information-containing item, comprising: at least one physical container structured and arranged to physically contain the at least one information-containing item; within such at least one physical container, a primary storage region structured and arranged to store the at least one information-containing item; at least one removable large divider structured and arranged to divide such primary storage region into at least two defined storage regions; and within such at least one physical container, at least two divider positioners structured and arranged to assist positioning of such at least one removable large divider in at least two set orientations, defining at least two arrangements of such at least two defined storage regions, by placement of such at least one removable large divider in either of two planes substantially perpendicular to each other; and at least one external interlocker structured and arranged to externally interlock such at least one physical container with at least one other such at least one physical-container; wherein such at least one removable large divider is substantially planar; wherein at least one of such at least two defined storage regions are structured and arranged to exactly contain one drawer; wherein at least one of the at least one information-containing items comprises at least one pressed-plastic recording comprising at least one outer album jacket having a nominal size of 12½ inches square; and wherein each one of such primary storage region and such at least two defined storage regions are structured and arranged to contain the at least one outer album jacket having a nominal size of 12½ inches square.

Moreover, it provides such a portable container system wherein essentially each such physical container comprises: a boxlike container comprising five external surfaces and one essentially open side adjoining such primary storage region; wherein such at least one interlocker comprises at least one first external surface, of such five external surfaces, comprising at least one projecting portion, and at least one second external surface, of such five external surfaces, opposing such at least one first external surface, comprising at least one inset portion fitting such at least one projecting portion. Additionally, it provides such a portable container system wherein such at least one projecting portion comprises at least one substantially square peg.

Also, it provides such a portable container system further comprising: at least one hanging file supporter structured and arranged to support hanging file folders within such at least one physical container; wherein such at least one hanging file supporter comprises at least one removable bar structured and arranged to span across such primary storage region. In addition, it provides such a portable container system further comprising such drawer. And, it provides such a portable container system wherein such at least one such defined storage region comprises at least one hand-access groove structured and arranged to assist hand manipulation of the at least one outer album jacket having a nominal size of 12½ inches square. Further, it provides such a portable container system wherein such at least one removable large divider comprises at least one vertical support adapted to vertically support the information-records.

Even further, it provides such a portable container system wherein such drawer comprises at least one finger-insertable opener structured and arranged to assist at least one user to open such drawer. Moreover, it provides such a portable container system wherein such drawer further comprises: at least one removable small divider structured and arranged to divide at least one first interior space of such drawer into at least two secondary interior spaces; and at least one removable mini divider structured and arranged to further divide at least one of such at least two secondary interior spaces into at least two smaller interior spaces.

Additionally, it provides such a portable container system further comprising: at least two such drawers, each one structured and arranged to fit within a respective one of such at least two defined storage regions; wherein such at least two such drawers together comprise at least one shared interlocker structured and arranged to externally interlock such at least two such drawers with such at least one external interlocker of such at least one physical container. Also, it provides such a portable container system wherein: each one of such at least two such drawers comprise at least one first external drawer surface and at least one second external drawer surface; such at least one shared interlocker comprises, within such at least one first external drawer surface, at least one projecting portion, and within such at least one second external drawer surface, at least one inset portion fitting such at least one projecting portion. In addition, it provides such a portable container system wherein such physical-container substantially comprises at least one engineered wood material. In addition, it provides such a portable container system wherein such physical-container substantially comprises at least one plastic material. And, it provides such a portable container system wherein the information-records may comprise at least one digital video device. Further, it provides such a portable container system wherein the information-records may comprise at least one compact disc. Even further, it provides such a portable container system wherein the information-records may comprise at least one cassette.

In accordance with another preferred embodiment hereof, this invention provides a method of use, of a portable container system by at least one disc jockey, comprising the steps of: providing at least one portable container system, relating to containing at least one storable item, such at least one portable container system comprising at least one first physical-container adapted to physically store information records, at least one second physical-container adapted to physically store such information records, at least two defined storage regions, at least one of such two defined storage regions being adapted to exactly contain one drawer, at least one removable large divider adapted to divide at least one of such first and such second physical-containers into such at least two defined storage regions, and at least one interlocker for interlocking such at least one first physical-container with such at least one second physical-container; portably storing, by at least one user, such information records within at least one storage region of at least one of such at least one first physical-container and such at least one second physical-container; and allowing such at least one user to portably store at least one accessory within such at least one storage region; wherein such at least one storage region is reconfigurable by such at least one user to accommodate storage of at least one combination of such at least one information-record and at least one file folder; wherein the information-records adapted to be stored include pressed-plastic recordings each comprising an album nominally 12½ inches square; and wherein such at least one user may be the at least one disc jockey.

In accordance with another preferred embodiment hereof, this invention provides a kit comprising: at least one physical container adapted to physically store at least one information-record adapted to reproduce information; at least one removable large divider adapted to divide such at least one first physical-container into a plurality of defined storage regions; at least one drawer structured and arranged to fit within one of such defined storage regions; and at least one hanging file supporter structured and arranged to support hanging file folders within such at least one physical container; wherein such at least one drawer may be further divided by at least one removable small divider; wherein such at least one drawer may be further divided by such at least one removable mini divider; and wherein such at least one physical container comprises at least one external interlocker structured and arranged to externally interlock such at least one physical container with at least one other such at least one physical-container. Even further, it provides such a kit wherein: such at least one defined storage space may be intentionally divided and assembled according to user-preference, to closely contain a specific size or shape of such at least one information-record.

In accordance with another preferred embodiment hereof, this invention provides a portable container system, relating to containing at least one storable item, comprising: at least one boxlike container having dimensions about 13 21/32 inches deep, about 14½ inches high and about 13⅜ inches wide; at least one removable large divider bifurcating such at least one physical-container and provides at least one support for at least one drawer; wherein such at least one drawer slidibly fits into such at least one physical-container allowing at least one user to open, close and remove such at least one drawer during at least one use; wherein such at least one drawer has dimensions of about 13⅛ inches deep, about 6¼ inches high and about 12-inches wide; wherein such at least one drawer may be further divided by at least one removable small divider; wherein such at least one removable small divider is about 12¼ inches long, about 5⅜ inches tall, and about ¼ inch wide; wherein such at least one drawer may be further divided by at least one removable mini divider; wherein such at least one removable mini divider is about 5⅜ inches long, about 5 13/32 inches tall and about 1/16 inch wide; and wherein such at least one physical-container comprises wood material, alternately, at least one plastic material.

In accordance with another preferred embodiment hereof, this invention provides a portable container system, relating to containing at least one storable item, comprising: at least one first physical-storer adapted to physically store information-records; at least one second physical-storer adapted to physically store such information-records; and at least two defined storage regions, at least one of such two defined storage regions being adapted to exactly contain one drawer; at least one removable large divider adapted to divide at least one of such first and second physical-storers into such at least two defined storage regions; and at least one interlocker for interlocking such at least one first physical-storer with such at least one second physical-storer; and wherein the information-records adapted to be stored include pressed-plastic recordings each comprising an album nominally 12½ inches square. In addition, it provides each and every novel feature, element, combination, step and/or method disclosed or suggested by this patent application.

DETAILED DESCRIPTION OF THE BEST MODES AND PREFERRED EMBODIMENTS OF THE INVENTION

Figure 1A:
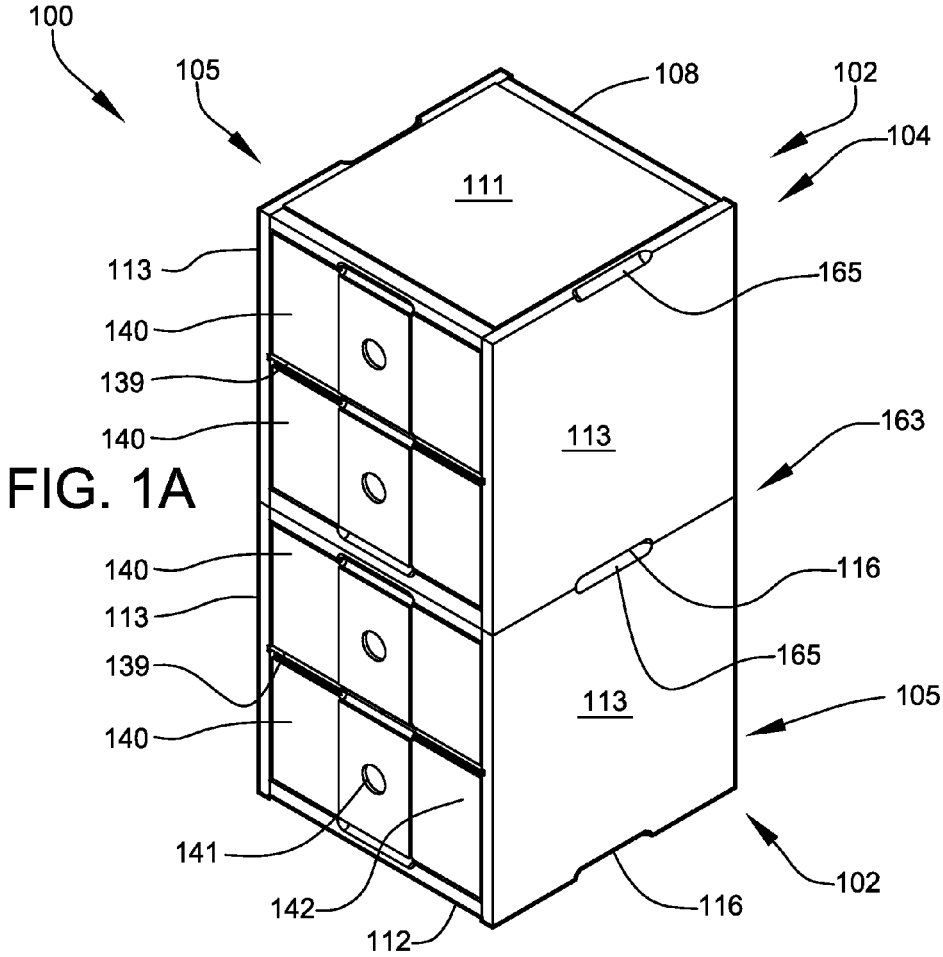
FIG. 1A shows a perspective view, illustrating the interconnectable, portable container-system, according to a preferred embodiment of the present invention.
Figure 1B:
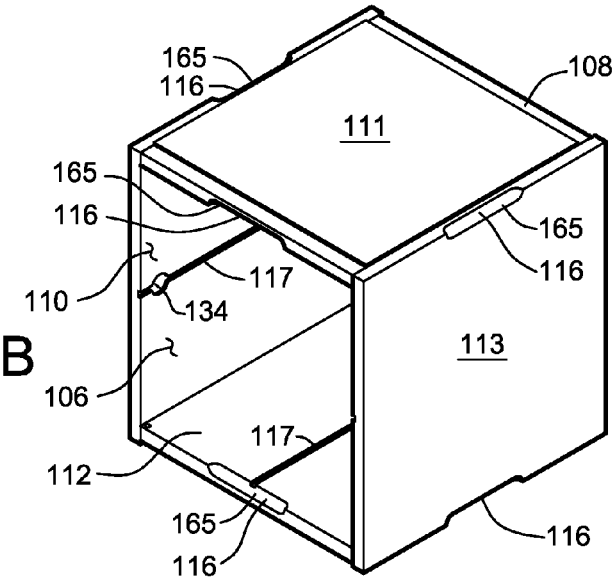
FIG. 1B shows a perspective view, illustrating a single box of the interconnectable, portable container-system, according to the preferred embodiment of FIG. 1A.

FIG. 1A shows a perspective view, illustrating interconnectable, portable container system 100, according to a preferred embodiment of the present invention. FIG. 1B shows a perspective view, illustrating a single box 105 of interconnectable, portable container system 100, according to the preferred embodiment of FIG. 1A. As best illustrated in FIG. 1B, box 105 of interconnectable, portable container system 100 preferably functions as the foundational physical component of the overall system (at least herein embodying at least one first physical-container). Box 105 is preferably configurable to assist in organizing, storing, and transporting multimedia 120 and related files 128, most preferably vinyl records 145 (as shown in FIG. 2 and FIG. 3A).

Each box 105 of apparatus 102 preferably comprises primary storage region 106, preferably comprising an interior space partially enclosed by the outer walls, as shown. Each box 105 is preferably structured and arranged to receive, within an interior space formed by the outer walls, one or more accessories 132, as shown, preferably used to enhance the functionality of the basic physical-container of FIG. 1B.

Box 105 preferably comprises a durable outer-shell 104, preferably comprising five external surfaces (i.e., top 111, bottom 112, back 108 and opposing sides 113) and preferably a single open end 110. It is noted that the term top, bottom, back, and sides are arbitrarily selected to facilitate the present teachings, and does should not be construed as being only preferred orientation of the component(s). The five external surfaces of box 105 preferably define a primary storage region 106, therein. Box 105 is preferably structured and arranged to mount and preferably support at least one large divider 139 for dividing primary storage region 106 into smaller defined storage regions 107 (at least embodying herein at least two defined storage regions), preferably for retaining at least one drawer 140, and/or for preferably retaining any combination of the mentioned accessories 132 comprising apparatus 102, according to the user's preference. Upon reading this specification, those with ordinary skill in the art will now appreciate that, under appropriate circumstances, considering such issues as design preference, user preference, marketing preference, cost, structural requirements, available materials, technological advances, etc., other boxlike containers arrangements and shapes such as, for example, square boxes, rectangular boxes, circular boxes, closed boxes, boxes with less than or more than five sides, non-boxes, etc., may suffice.

Figure 2:
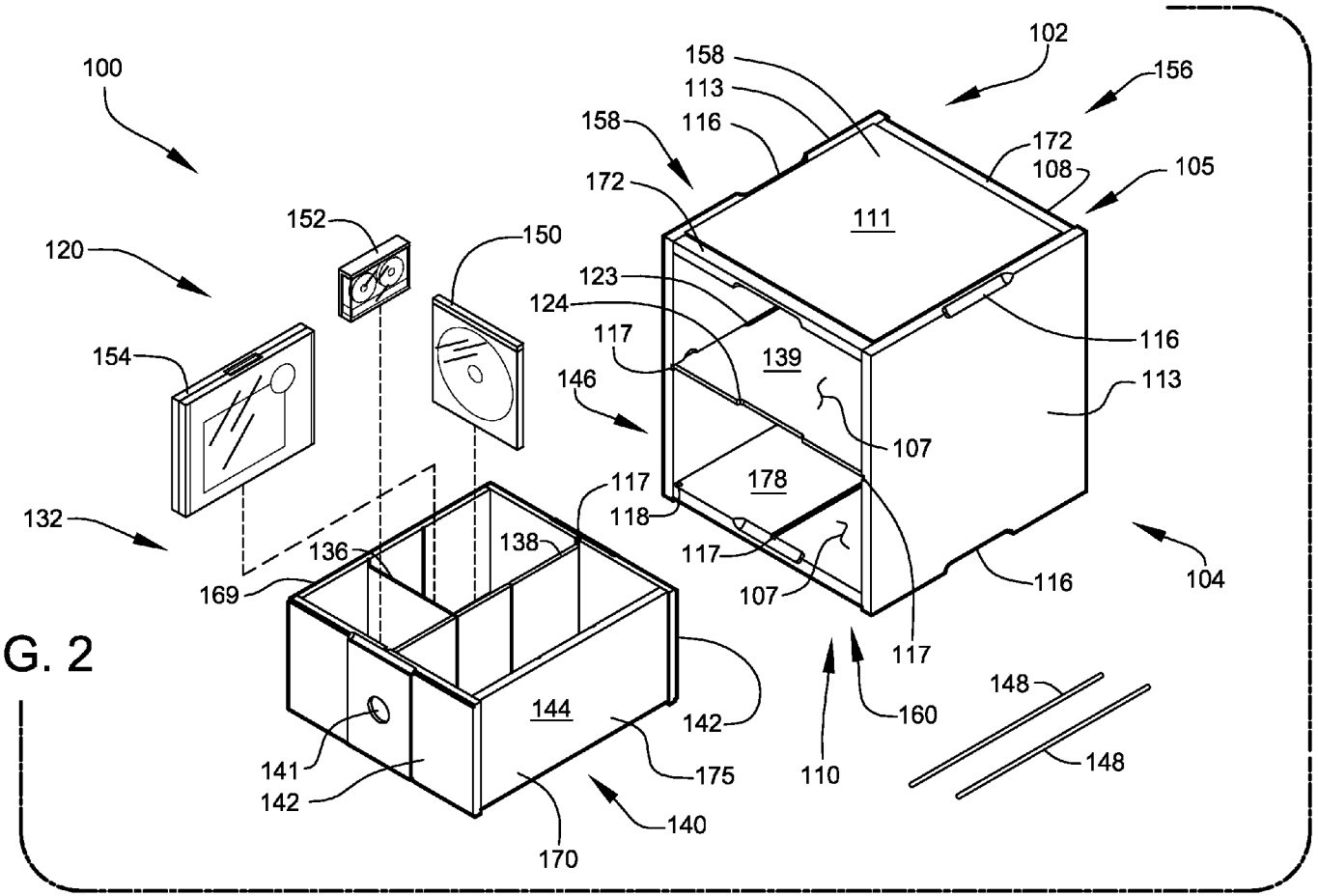
FIG. 2 shows an isometric view, illustrating a removable and stackable drawer as a component that fits into the interconnectable, portable container-system, according to the preferred embodiment of FIG. 1A.

FIG. 2 shows an isometric view, illustrating drawer 140 as a component that fits with interconnectable, portable container system 100, according to the preferred embodiment of FIG. 1A. Preferably, box 105 may be combined with one or more accessories 132 to form apparatus 102, preferably used to assist storage, portability, and display of multimedia items 120 of various sizes and shapes; and may preferably be used to assist operation of an entertainment business, preferably a disc jockey (DJ) business. Multimedia items 120 that may be stored may also preferably include at least one CD 150, at least one cassette 152, at least one DVD 154 and may include other forms of information-records.

Accessories 132 preferably include at least one removable large divider 139 and at least one removable drawer 140, as shown. Furthermore, apparatus 102 is preferably designed to accept additional accessories 132, which preferably may include at least one hanging file supporter 180 structured and arranged to support hanging files 128 within primary storage region 106, as shown. Apparatus 102 is preferably modifiable to comprise a plurality of drawers 140, as illustrated in FIG. 1A. Alternately preferably, apparatus 102 may comprise exactly one drawer 140, as illustrated in FIG. 2. Drawers 140 are preferably sized to generally match the standardized peripheral dimensions of the outer cover 147 of vinyl records 145. Upon reading this specification, those with ordinary skill in the art will now appreciate that, under appropriate circumstances, considering such issues as design preference, user preference, marketing preference, cost, structural requirements, available materials, technological advances, etc., other drawer-like containers such as, for example, square boxes, non-boxes, circular boxes, etc., may suffice.

Preferably, hanging file supporter 180 comprises a set of dowels 148, preferably for supporting clips 130 to hang at least one file folder 129 (at least herein embodying at least one system for hanging file folders; and at least herein embodying wherein said at least one system for hanging file folders is installed in at least one said physical-container), as shown in FIG. 3A. Preferably dowels 148 are removably engaged within receiving sockets 118 of inner surface 178, as shown. Upon reading this specification, those with ordinary skill in the art will now appreciate that, under appropriate circumstances, considering such issues as design preference, user preference, marketing preference, cost, structural requirements, available materials, technological advances, etc., other systems and arrangements for file holding such as, for example, knobs, hooks, Velcro, etc., may suffice.

Figure 3B:
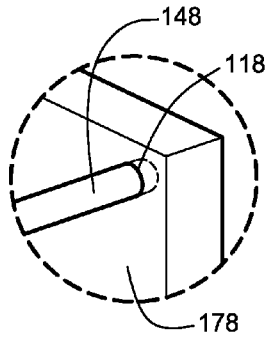
FIG. 3B shows a perspective view, illustrating a portion of the dowel, engaging a receiving socket of the interconnectable portable container-system, enlarged for magnification purposes.
Figure 3A:
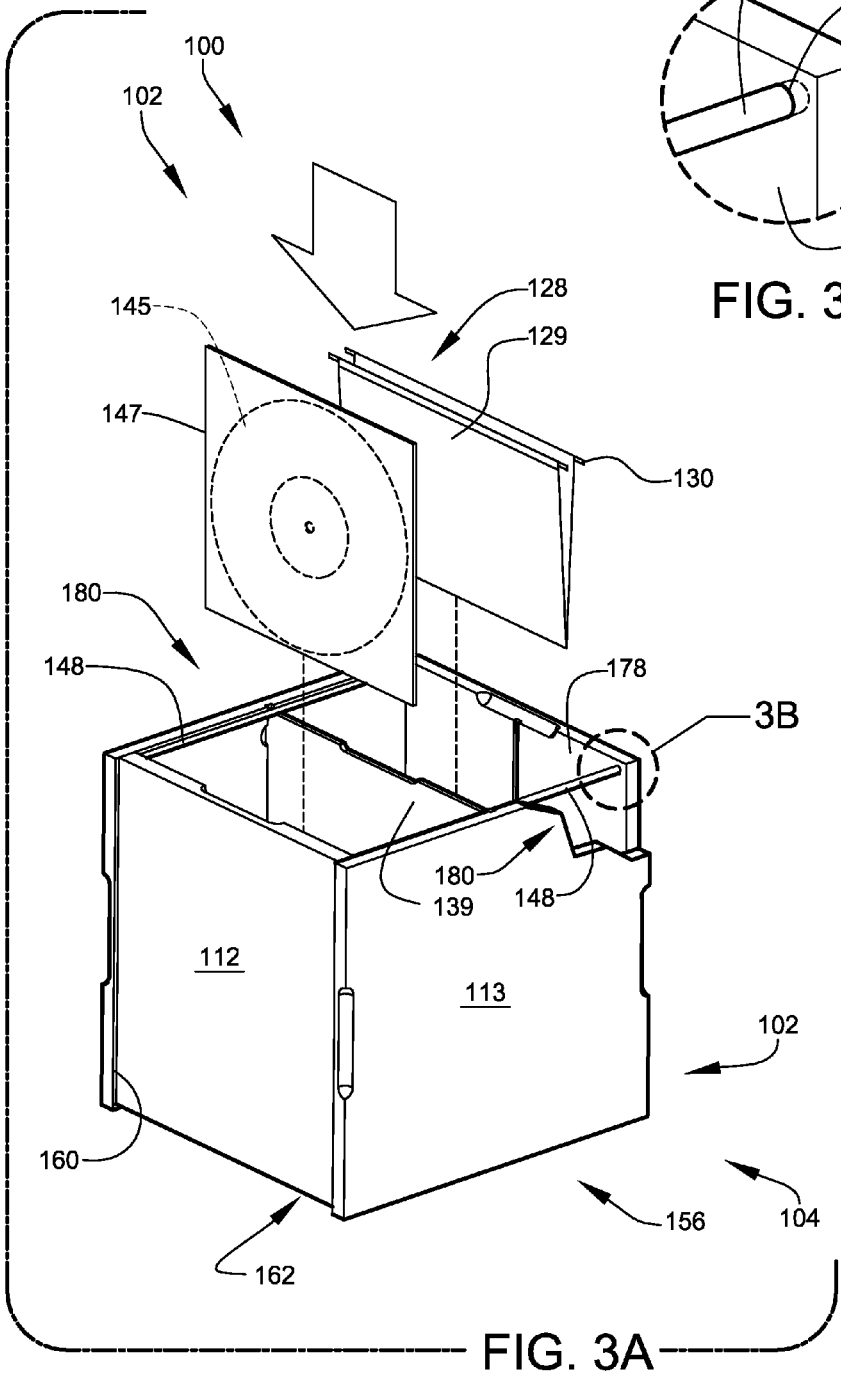
FIG. 3A shows an isometric view, illustrating a dowel as a component that fits into the interconnectable, portable container-system, allowing files to be stored and transported, according to the preferred embodiment of FIG. 1A.

Preferably, a pair of receiving sockets 118 are drilled (each preferably about ¼ inch in diameter and preferably about 1/16-inch deep) into opposing inner surfaces 178 of top 111 and bottom 112, as shown. Preferably, the center of receiving socket 118 is situated in the outer corner regions, as shown, preferably about 11/32-inch away from the inner faces of the adjacent sides 113 and preferably about 12½ inches forward of the interior face of back 108. Receiving socket 118 is purposely arranged as shown in FIG. 3B, so that a user can bend dowel 148 sufficiently to insert or remove dowel 148 with ease.

The two dowels 148 are preferably inserted in receiving sockets 118 in sides 113, each dowel 148 preferably mounted as shown (another dowel 148 is inserted into receiving sockets 118 parallel to dowel 148 adjacent to side 113). File 128 is preferably hung using dowels 148 in a vertical orientation, as shown. All business papers, song lists, and lyrics may be safely and conveniently stored and transported in files 128 in apparatus 102. Vinyl record 145 may be stored vertically, as shown, provided dowels 148 are removed.

A plurality of apparatuses 102 may preferably be stacked vertically, preferably one box 105 on top of another box 105, as shown. Apparatus 102 is preferably adapted to permit the inter-engagement of multiple interconnectable boxes 105, which may preferably be stacked horizontally and/or vertically together, as shown in FIG. 1A.

Box 105 preferably comprises particle board, a relatively inexpensive, engineered, wood product made from particles of wood, such as wood chips, shavings, and dust. Particle board provides the preferred "environmentally-friendly" and "nostalgic" look and feel that is desired within the vinyl-based DJ entertainment industry (at least embodying herein at least one engineered wood material). A synthetic resin is used to bind the wooden materials as they are pressed together during manufacture to form a sufficiently rigid, wood-based, planar surface. Upon reading this specification, those with ordinary skill in the art will now appreciate that, under appropriate circumstances, considering such issues as design preference, user preference, marketing preference, cost, structural requirements, available materials, technological advances, etc., other box material arrangements such as, for example, Medium Density Fiberboard (hereinafter "MDF"), Oriented Strand Board (herein after "OSB"), plywood of various qualities, composites, plastics, cardboard, glass, ferrous and non-ferrous materials, etc., may suffice.

In the natural environment where a DJ may work, drinks may be spilled thereby compromising the structural integrity of box 105. Box 105 is preferably made substantially water resistant by the application of at least one outer finish, to protect it in its natural working environment. Preferred outer finishes include polyurethane coatings, alternately preferably paint, alternately preferably surface-applied laminates. Upon reading this specification, those with ordinary skill in the art will now appreciate that, under appropriate circumstances, considering such issues as design preference, user preference, marketing preference, cost, structural requirements, available materials, technological advances, etc., other resin arrangements such as, for example, epoxy resins, unsaturated polyester resin, melamine resins, acetal resins, other waterproofing means, varnishing, etc., may suffice.

Alternately preferably, box 105 is formed from at least one plastic material. Plastics suitable for use in the construction of box 105 preferably include Plexiglas and acrylic. A color may preferably be applied to the plastic materials by coating, mixing or blending the material forming box 105 with a pigment and/or dye, or other compatible methods. Preferred alternate embodiments of box 105 preferably comprise one or more removable outer walls to facilitate flat packing and shipping.

Sides 113 of box 105 are preferably mounted exterior to back 108, top 111, and bottom 112, preferably to minimize viewing of joints, thereby enhancing both the aesthetic appearance and functional stability for stacking boxes 105. Adhesive, preferably carpenter's glue, is preferably used during manufacturing of apparatus 102, to preferably join sides 113 of box 105, as shown in FIG. 2. Upon reading this specification, those with ordinary skill in the art will now appreciate that, under appropriate circumstances, considering such issues as design preference, user preference, marketing preference, cost, structural requirements, available materials, technological advances, etc., other fastening arrangements such as, for example, glues such as cyanoacrylate, contact cement, polyvinyl acetate, polyurethane glue as made by Gorilla Glue and Excel, other fasteners such as nails, screws, tacks, staples, and other specific cuts that can be fitted together, for example, tongue and groove, etc., may suffice.

Nailing and a minimal amount of adhesive are preferably used during the gluing process (not shown) to keep box 105 properly aligned and keep joint-gaps minimized. Upon reading this specification, those with ordinary skill in the art will now appreciate that, under appropriate circumstances, considering such issues as design preference, user preference, marketing preference, cost, structural requirements, available materials, technological advances, etc., other holding arrangements such as, for example, clamping, chains, ties, wraps, nails, screws, tacks, staples, etc., may suffice.

Figure 4A:
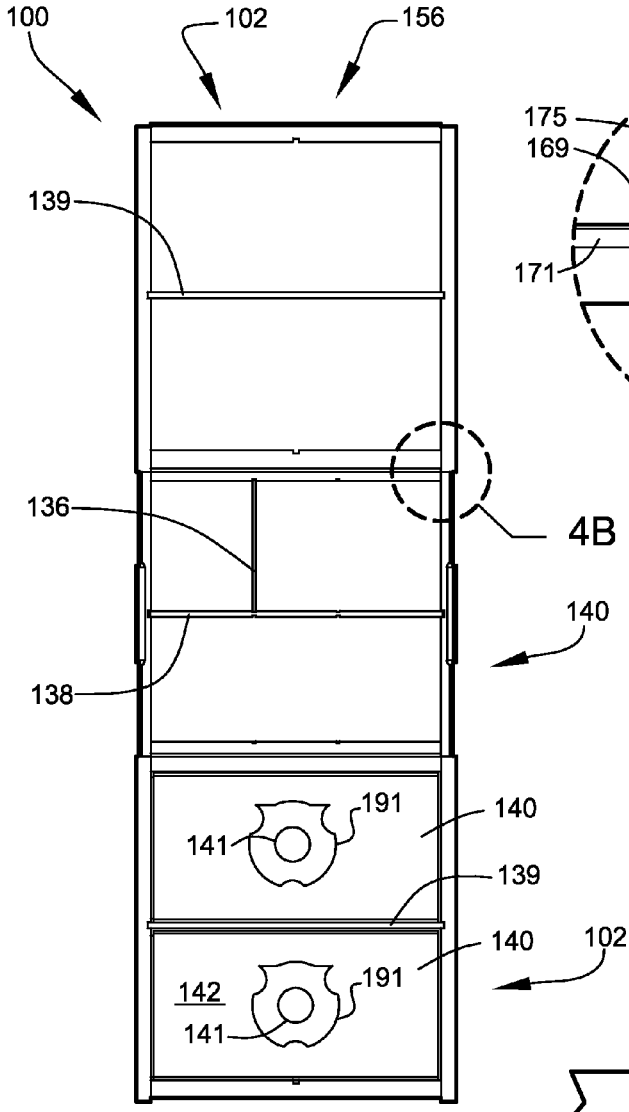
FIG. 4A shows a plan view, illustrating the front of the interconnectable, portable container-system as stacked or inter-connected, according to the preferred embodiment of FIG. 1A.
Figure 4B:
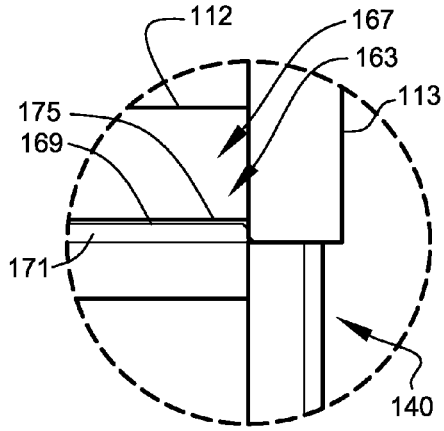
FIG. 4B shows a side view, illustrating a preferred stacked engagement of the interconnectable, portable container-system, enlarged for magnification purposes.
Figure 4C:
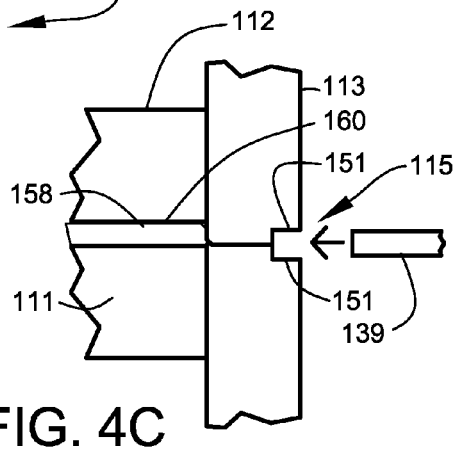
FIG. 4C shows a side view, illustrating an alternate preferred stacking engagement of the interconnectable, portable container-system, enlarged for magnification purposes.

Sides 113 preferably comprise a thickness of about ⅝-inch, cut to preferably comprise a depth of about 13⅞, more preferably 13 27/32 inches and a height of about 14 7/16 inches. A quarter-round dado 165, preferably about ⅜ inch deep, is preferably routed into the outer top-edge and bottom-edge of side 113, preferably starting at a reference point about 4¾ inches from the rear of side 113 and about 4¾ inches from the front. Dado 165 is about 4 11/32 inches long and serves as an outer groove-hold 116, whereby the user can easily grasp box 105 with his or her fingers for lifting, stacking, or un-stacking a plurality of boxes 105. Alternately preferably, a continuous dado 151, extending front to back along the upper and lower edges of sides 113, preferably provides an alternate outer groove-hold 116', as best illustrated in FIG. 4C. Dado 151 preferably comprises a depth of about ¼ inch and a height of about ⅛ inch. When two boxes 105 incorporating dado 151 are stacked, as illustrated in FIG. 4C, a continuous outer groove-hold, identified herein as slot 115, is preferably formed between the boxes, preferably allowing large divider 139 to be engaged therein. Thus, the system may be configured to form additional useful stacked configurations.

Each side 113 preferably has at least one square-groove 117 measuring about ¼-inch square, preferably cut horizontally along the length of the inner face centerline, as shown. This provides a space wherein large divider 139 can be inserted to bifurcate box 105, as shown in FIG. 2. Both top 111 and bottom 112 preferably comprised similar square-grooves 117, in essence functioning as at least two divider positioners structured and arranged to assist positioning of large divider 139 in at least two set orientations, thereby defining at least two arrangements of such at least two defined smaller storage regions 107, by placement of large divider 139 in either of two planes substantially perpendicular to each other. Upon reading this specification, those with ordinary skill in the art will now appreciate that, under appropriate circumstances, considering such issues as design preference, user preference, marketing preference, cost, structural requirements, available materials, technological advances, etc., other dimensional and divider arrangements such as, for example, other dimensions at different orientations and/or places, divider may or may not be in place, there may be multiple grooves cut for multiple dividers and grooves may have different geometries, divider may include slides, rollers, magnets, etc., may suffice.

In preferred embodiments of the system, a small circular recess 134 is preferably formed within the interiors of each side 113 approximately 1 inch from the edge of open end 110. This optional recess 134 is preferably located on axis with square-groove 117, as shown, and preferably functions to provide clearance for a user's fingers between side 113 and a stack of vinyl records 145 situated within box 105.

Sides 113 are preferably joined perpendicular to top 111 and to bottom 112, as shown. The front of box 105 comprises open end 110 and is flush fit, as shown. Sides 113 are offset about 3/16 inch below bottom 112 and are also offset about 3/16 inch beyond back 108. These offsets 162 are preferred to form an external interlocker 163 to enable the interconnectability (interlocking) of two or more apparatuses 102 when stacked vertically and/or horizontally, as shown in FIG. 1A and FIG. 4A. Upon reading this specification, those with ordinary skill in the art will now appreciate that, under appropriate circumstances, considering such issues as design preference, user preference, marketing preference, cost, structural requirements, available materials, technological advances, etc., other interconnectability promoters such as, for example, other offset dimensions at different orientations and/or places, means whereby clasps, clamps, adhesives, Velcro, snaps, hooks, etc., may suffice.

Bottom 112 preferably comprises fiber board having a thickness of about ¾ inch and is preferably cut to measure a width of about 12⅛ inches and a depth of about 13 21/32 inches. Bottom 112 and top 111 each preferably have about a ¼-inch-square groove 117, preferably cut orthogonally along the length of inner-face at about the centerline of the panel.

Offsets 162, on external surface of bottom 112, preferably form a recessed socket 160, wherein the projecting external surface of top 111, situate opposite bottom 112 (at least herein embodying at least one second such external surface), preferably acts as a complementary mating structure, preferably functioning as at least one outwardly-projecting peg 158. Peg 158 and socket 160 together provide a preferred means for physical interlocking of two or more boxes 105, such as, for example, during stacking and storing (at least herein embodying at least one interlocker for interlocking; and at least herein embodying at least one projecting portion; and at least herein embodying at least one first such external surface having at least one projecting portion). Upon reading this specification, those with ordinary skill in the art will now appreciate that, under appropriate circumstances, considering such issues as design preference, user preference, marketing preference, cost, structural requirements, available materials, technological advances, etc., other projecting and recessed relationships such as, for example, surface-locks of different shapes and/or orientations, multiple projecting and/or projecting surfaces, magnets, etc., may suffice.

In alternate preferred embodiments of the system, another partial dado 165, preferably having a recessed quarter-round profile of about ⅜-inch deep is preferably routed into the inner edge of top 111, preferably starting at a reference point about 3⅞ inches from the inner-face of sides 113. This optional dado 165 preferably comprises a length of about 4⅜ inches and preferably serves as an inner groove-hold 116, whereby a user can easily grasp box 105 with fingers for moving, lifting, stacking, or un-stacking a plurality of boxes 105, even when the box is substantially full of vinyl records 145. A similar partial dado 165 is preferably routed into the inner edge of bottom 112, as shown. Upon reading this specification, those with ordinary skill in the art will now appreciate that, under appropriate circumstances, considering such issues as design preference, user preference, marketing preference, cost, structural requirements, available materials, technological advances, etc., other information-records such as, for example, smaller or larger sized albums, with or without their covers cassettes, DVD's, video tapes, CD's, USB's, etc., may suffice.

Groove-hold 116 also serves to allow a user to more easily "thumb" through and select vinyl records 145. Upon reading this specification, those with ordinary skill in the art will now appreciate that, under appropriate circumstances, considering such issues as design preference, user preference, marketing preference, cost, structural requirements, available materials, technological advances, etc., other dimensional and groove grasping arrangements such as, for example, other dimensions at different orientations and/or places, handles, knobs, finger holes, different shaped holes, etc., may suffice.

Upon reading this specification, those with ordinary skill in the art will now appreciate that, under appropriate circumstances, considering such issues as design preference, user preference, marketing preference, cost, structural requirements, available materials, technological advances, etc., other dimensional and groove-hold grasping arrangements such as, for example, other dimensions at different orientations and/or places, handles, hooks, knobs, finger holes, etc., may suffice.

Top 111 preferably comprises a thickness of about ¾ inch and is preferably cut to comprise a width of about 12⅛ inches and a depth of about 13 21/32 inches. The preferred size precisely accommodates at least one vinyl record 145 preferably including its cover 147, as shown in FIG. 3A. It is noted that cover 147 customarily comprises outer-edge dimensions of about 12½ by about 12½ inches (at least herein embodying wherein the information-records adapted to be stored comprise pressed-plastic recordings each comprising an album nominally 12½ inches square). Upon reading this specification, those with ordinary skill in the art will now appreciate that, under appropriate circumstances, considering such issues as design preference, user preference, marketing preference, cost, structural requirements, available materials, technological advances, etc., other information-records type, storage orientation and size such as, for example, other types of information records comprising different material and/or shape, other dimensions less than or more than 12½ inches, information-records stored at different orientations such as horizontally, diagonally, etc., may suffice.

Rabbet 172 is preferably cut to a depth of about ⅛ inch with a preferred width of about ¾ inch. Rabbet 172 is preferably cut on the front and rear peripheral edges of top 111, as shown, to provide raised peg 158 comprising a part projection of about ⅛ inch. The peripheral edges of raised peg 158 are preferably modified to form a chamfer, as shown or similar edge relief, to facilitate the stacking engagements illustrated herein. Peg 158 is preferably a match fit for socket 160 to enhance stackability by effectively interlocking the box structures.

Large divider 139 is preferably manufactured from MDF, alternately preferably Masonite. Large divider 139 is preferably planar and is preferably about 12⅜ inches wide, preferably about 13⅛ inches deep, and preferably about ¼ inch thick. Alternately preferably, large divider 139 is manufactured from plastic.

Large divider 139 (at least herein embodying wherein at least one such removable large divider is planar), is removable and preferably vertically or, alternately preferably, horizontally, bifurcates storage region 146 of box 105 (at least herein embodying at least one removable large divider adapted to divide at least one of such physical-containers into at least two defined storage regions). Upon reading this specification, those with ordinary skill in the art will now appreciate that, under appropriate circumstances, considering such issues as design preference, user preference, marketing preference, cost, structural requirements, available materials, technological advances, etc., other dividers such as, for example, dividers made from alternate materials, dividers of different size, shape, a greater number of dividers, no divider, etc., may suffice.

Large divider 139 preferably divides box 105 vertically to help support at least one vinyl record 145. This assists in maintaining the albums in an optimal storage orientation. Alternately preferably, a user may also use large divider 139 to divide horizontally the space for a particular application, for example to store drawers 140, large divider 139 (at least herein embodying wherein said at least one removable large divider comprises at least one vertical support adapted to vertically support the information-records; and at least herein embodying wherein at least one such removable divider is adapted to so divide at least one of such physical-containers into at least two defined storage regions by placement in either of two planes perpendicular to each other) may be removed and reinserted in a perpendicular planar orientation. Upon reading this specification, those with ordinary skill in the art will now appreciate that, under appropriate circumstances, considering such issues as design preference, user preference, marketing preference, cost, structural requirements, available materials, technological advances, etc., other divider means and orientations such as, for example, divider may also be orientated diagonally, divider may be fixed and not removable, there may be more than one divider, etc., may suffice.

In preferred embodiments of the system, least one notch 123 is preferably routed on each outside edge of large divider 139. Notch 123 (nearest side 113), as shown, is preferably about 4⅜ inches long and is preferably about 5/16 inches wide, Notch 123 starting preferably 4 5/16 inches from the front edge of large divider 139. Notch 123 preferably begins and ends with at least one about ¼-inch radius 124, as shown in FIG. 2.

A mirror image of notch 123 is cut on opposite edge of large divider 139 near side 113, not shown in FIG. 2. Upon reading this specification, those with ordinary skill in the art will now appreciate that, under appropriate circumstances, considering such issues as design preference, user preference, marketing preference, cost, structural requirements, available materials, technological advances, etc., other divider materials and arrangements such as, for example, divider may also be made of MDF, fiberboard, OSB, plywood of various qualities, composites, plastics, ferrous and non-ferrous materials, divider may be made to different sizes and dimensions, with or without notches, holes may be provided for grasping or cable routing, etc., may suffice.

Large divider 139 preferably has notch 123 cut about 4¼ inches long on front-edge, as shown in FIG. 2 and preferably cut on rear outer-edge, as not shown in FIG. 2. Notch 123 preferably begins and ends with about ¼-inch radius 124, as shown, and preferably has starting point situated about four inches from the edge of nearest side 113.

Using the exact dimensions called out within this specification of the preferred embodiment allows adequate tolerance between components, for freedom of movement, for example when sliding large divider 139 into box 105. Applicant has experimented and has found the described dimensions applicable for preferable use in the application described. Upon reading this specification, those with ordinary skill in the art will now appreciate that, under appropriate circumstances, considering such issues as design preference, user preference, marketing preference, cost, structural requirements, available materials, technological advances, etc., other applications or embodiment arrangements such as, for example, different sizes and dimensions, different numbers of boxes, boxes being used for different purposes, etc., may suffice.

In a preferred embodiment of the present invention, square-grooves 117 may preferably comprise a slightly narrowing width (front to back) to permit a user to frictionally "wedge" large divider 139 within the opposing square-grooves 117. This assists in maintaining large divider 139 within primary storage region 106, even as drawer 140 is slid in and out of smaller defined storage regions 107. Alternately preferably, large divider 139 may be mechanically locked within square-grooves 117 by the placement of at least one frictional retainer preferably placed between a face of large divider 139 and the interior of square-groove 117. In a preferred arrangement, the frictional retainer may preferably comprise a appropriate oval-head wood screw installed within square-groove 117 about one inch forward of back 108 (as to frictionally engage large divider 139 when installed). The depth of the screw may be adjusted to provide optimal retention of large divider 139. Upon reading this specification, those with ordinary skill in the art will now appreciate that, under appropriate circumstances, considering such issues as cost, user preference, etc., other mechanical retainers arrangements such as, for example, clips, springs, etc., may suffice.

Drawer 140, as shown in FIG. 2, is preferably used in box 105 to further organize and store preferably smaller items of multimedia 120, such as CDs 150, DVDs 154, or cassettes 152. FIG. 1A illustrates the preferred embodiment of apparatus 102 preferably using two drawers 140 and FIG. 2 shows an alternate preferred embodiment with exactly only one drawer 140, preferably when getting multimedia 120 out of drawer 140, separate and apart from apparatus 102. Alternately preferably, no drawers 140 need to be used with apparatus 102.

Drawer 140 is preferably bifurcated, preferably using at least one removable small divider 138 that fits in at least one vertical square-groove 117 preferably measuring about ¼-inch square. Small divider 138 preferably is about 12¼ inches long, preferably about 5⅜ inches tall, and preferably about ¼ inch wide.

At least one removable mini-divider 136 is preferably used in the preferred embodiment of the present invention. Mini-dividers 136 are preferably inserted perpendicular to small divider 138 in vertical square-groove 126, as shown, that preferably measures about 1/16-inch square. Mini-divider 136 preferably measures about 5⅜ inches long, preferably about 5 13/32-inches tall and preferably about 1/16-inch wide.

Drawer 140 preferably has two drawer-sides 144, as shown, preferably made from fiber board having a preferred thickness of about ½ inch, and two opposing preferably identical drawer-faces 142 (so the back and front of drawer 140 are non-distinguishable from each other to aid in quick reassembly).

Drawer 140 preferably has outer dimensions of about 11 27/32 inches wide, about 13⅛ inches long and about 6 7/64 inches deep. This preferred dimensioning allows two drawers 140 to preferably fit in box 105 (at least herein embodying wherein at least one of such defined storage regions is adapted to exactly contain one drawer).

Preferably, at least one finger-hole 141 is positioned in the center of drawer-face 142, as shown. Finger-hole 141 preferably has an outer diameter 135 of about a 2 inches and an inner diameter 137 of about 2¼ inches, as best illustrated in FIG. 5C. Finger-hole 141 preferably comprises a depth of about 11/32 inch. Finger-hole 141 preferably permits a user grasp and manipulate the drawer. Upon reading this specification, those with ordinary skill in the art will now appreciate that, under appropriate circumstances, considering such issues as design preference, user preference, marketing preference, cost, structural requirements, available materials, technological advances, etc., other physical-containers combinations such as, for example, may include more than two containers, may not include second container, etc., may suffice.

FIG. 3A shows an isometric view, illustrating dowel 148 as a component that preferably fits into the interconnectable, portable container-system, preferably allowing files 128 to be stored and transported, according to the preferred embodiment of FIG. 1A. FIG. 3B shows a perspective view, illustrating an end portion of dowel 148, engaging a receiving socket of the interconnectable portable container-system, enlarged for magnification purposes.

FIG. 4A shows a plan view, illustrating the front of the interconnectable, portable container-system 100, in a stacked and inter-connected arrangement, according to the preferred embodiment of FIG. 1A. FIG. 4B shows a side view, illustrating a preferred stacked engagement of interconnectable, portable container-system 100, enlarged for magnification purposes.

A plurality of apparatuses 102 may be inter-connected, preferably using external interlocker 163, to form a variety of different horizontal and vertical stacked combinations, as shown. The various combinations for stacking can be used for safely and efficiently storing or transporting multimedia 120 and DJ-related business paperwork. The preferred method of use of the present invention allows for combinations of accessories to be tailored to specific needs of a DJ or user and can be easily altered as required, according to the application being performed. Apparatuses 102 are shown in a preferred inter-connected state, as an example of how a user may custom-configure kit 158 according to user-preference or specific application. A preferred embodiment of kit 158 preferably comprises: box 105, large divider 139, one or more drawers 140, small divider 138, mini divider 136, and sockets for receiving dowels 148, as shown. Upon reading this specification, those with ordinary skill in the art will now appreciate that, under appropriate circumstances, considering such issues as design preference, user preference, marketing preference, cost, structural requirements, available materials, technological advances, etc., other kit arrangements such as, for example, may include more than two containers, the inclusion of more than one box, specialty dividers such as wine bottle supports, indexing indicia, books, instructions for use, etc., may suffice.

Figure 5A:
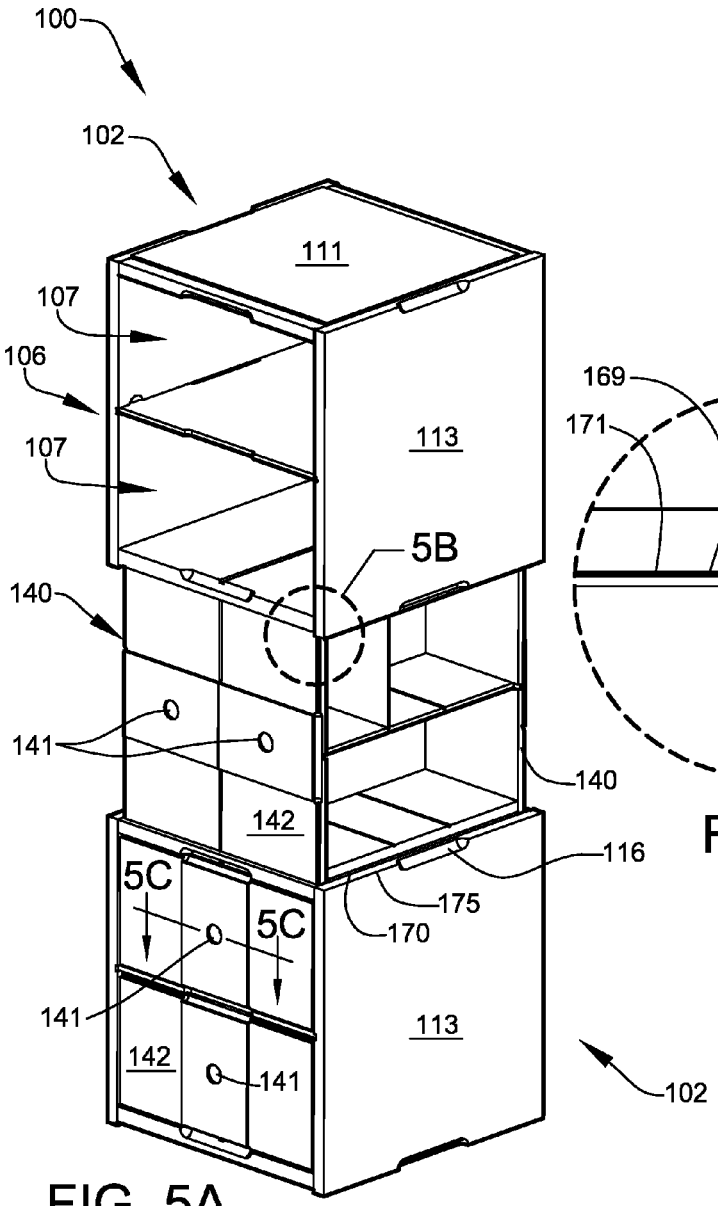
FIG. 5A shows a perspective view, illustrating a set of two drawers arranged "back-to-back" to enable interlock stacking within the interconnectable, portable container-system, according to the preferred embodiment of FIG. 1A.
Figure 5B:
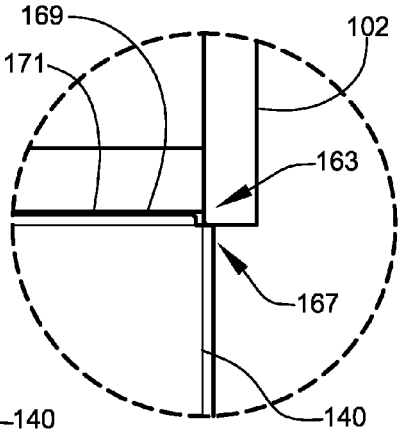
FIG. 5B shows a side view, illustrating another preferred stacked engagement of the interconnectable, portable container-system, enlarged for magnification purposes.
Figure 5C:
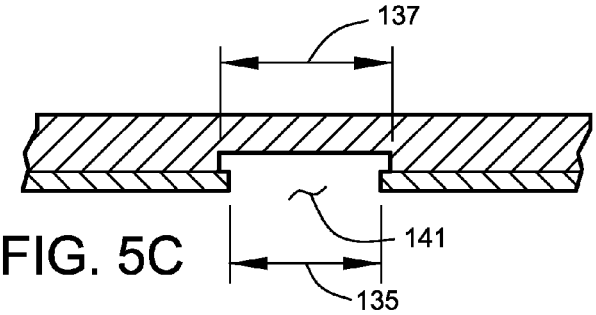
FIG. 5C is a sectional view through the section 5C-5C of FIG. 5A, illustrating preferred arrangements of a finger-hole formed within a wall of the drawer.

FIG. 5A shows a perspective view, illustrating a set of two drawers 140 in a "back-to-back" arrangement enabling the interlocked stacking of both drawers 140 with apparatus 102 of interconnectable portable container-system 102. FIG. 5B shows a side view, illustrating the preferred stacked engagement of FIG. 5A, enlarged for magnification purposes.

Preferably, the two drawers 140 together form a shared interlocker 167 structured and arranged to externally interlock with external interlocker 163 of one or more apparatus 102. Preferably, each one the two drawers 140 comprise at least one first external drawer surface 169 and at least one second external drawer surface 170 (also identified herein as drawer-side 144 in FIG. 2), as shown. Preferably, shared interlocker 167 comprises at least one projecting portion 171 located within first external drawer surface 169, as shown. At least one inset portion 175 within said at least one second external drawer surface, designed to fit projecting portion 171 in a complementary manner. Thus, the set of two drawers 140 placed back-to-back form a preferred stackable component of apparatus 102.

The two drawers 140 of FIG. 4A are illustrated with alternate preferred drawer faces comprising graspable panels 191 positioned in the center of drawer-face 142. Graspable panels 191 may preferably comprise identifiable shapes, such as, for example, a stylized buffalo head, geometric shapes, etc. When such graspable panels 191 are utilized, it is preferred that the inner groove-hold 116 be eliminated, as shown.

FIG. 5C is a sectional view through the section 5C-5C of FIG. 5A, illustrating preferred arrangements of finger-hole 141 formed within drawer 140.

Although the applicant has described the applicant's preferred embodiments of this invention, it will be understood that the broadest scope of this invention includes modifications such as diverse shapes, sizes, and materials. Such scope is limited only by the below claims as read in connection with the above specification. Further, many other advantages of the applicant's invention will be apparent to those skilled in the art from the above descriptions and the below claims.

What is claimed is:

1. A portable container system comprising in combination:

a) a first box including:

i) a generally square-shaped back panel, opposing top and bottom panels, and opposing side panels, the first box having an open end opposite the back panel thereof, the first box enclosing a first storage region, the top panel and bottom panel being spaced from each other by a predetermined distance;

ii) the opposing side panels of the first box having upper and lower ends, the lower ends of the opposing side panels extending below and beyond the bottom panel of the first box;

iii) the top panel of the first box including a generally flat projection extending above and beyond the upper ends of the opposing side panels, the generally flat projection having front and rear portions, the top panel of the first box further including front and rear peripheral edges having rabbets formed therein bordering the front and rear portions of the generally flat projection of the top panel;

b) a second box including:

i) a generally square-shaped back panel, opposing top and bottom panels, and opposing side panels, the second box having an open end opposite the back panel thereof, the second box enclosing a second storage region, the top panel and bottom panel being spaced from each other by said predetermined distance;

ii) the opposing side panels of the second box having upper and lower ends, the lower ends of the opposing side panels extending below and beyond the bottom panel of the second box;

iii) the top panel of the second box including a generally flat projection extending above and beyond the upper ends of the opposing side panels, the generally flat projection having front and rear portions, the top panel of the second box further including front and rear peripheral edges having rabbets formed therein bordering the front and rear portions of the generally flat projection of the top panel;

c) first and second drawers dimensioned to fit within one of the first and second storage regions of the first and second boxes, respectively, each of said first and second drawers including opposing front and rear drawer faces, first and second opposing drawer sides, and a bottom, and each of said first and second drawers having a height that is approximately one-half of said predetermined distance;

d) the first drawer being supported upon the top panel of the first box, one of the drawer sides of the first drawer engaging the generally flat projection of the top panel of the first box, and the opposing drawer side of the first drawer facing upwardly;

e) the second drawer being supported upon the top panel of the first box, one of the drawer sides of the second drawer engaging the generally flat projection of the top panel of the first box, and the opposing drawer side of the second drawer facing upwardly;

f) the bottoms of the first and second drawers extending generally vertically adjacent one another; and g) the second box being supported upon the first and second drawers, the second box engaging the upwardly facing drawer sides of the first and second drawers.

2. The portable container system according to claim 1 wherein the second box includes at least one hand-access groove formed within at least one of the opposing top and bottom panels and opposing side panels.

3. The portable container system according to claim 1 wherein the first and second boxes are substantially formed of at least one engineered wood material.

4. The portable container system recited by claim 1 wherein:

a) the opposing side panels of the first box each has a rear end, the rear ends of the opposing side panels extending behind and beyond the back panel of the first box;

b) the opposing side panels of the second box each has a rear end, the rear ends of the opposing side panels extending behind and beyond the back panel of the second box;

c) wherein the back panel of the second box may be placed atop the top panel of the first box to interlock the generally flat projection of the top panel of the first box with the back panel, and rear ends of the opposing side panels, of the second box.

* * * * *